US012788118B2

(12) United States Patent
Kehinde

(10) Patent No.: US 12,788,118 B2
(45) Date of Patent: Nov. 10, 2026

(54) CLOSURE FOR JEWELRY

(71) Applicant: Rachel O Kehinde, Brooklyn, NY (US)

(72) Inventor: Rachel O Kehinde, Brooklyn, NY (US)

( * ) Notice: Subject to any disclaimer, the term of this patent is extended or adjusted under 35 U.S.C. 154(b) by 18 days.

(21) Appl. No.: 18/882,676

(22) Filed: Sep. 11, 2024

(65) Prior Publication Data

US 2025/0089861 A1 Mar. 20, 2025

Related U.S. Application Data

(60) Provisional application No. 63/538,876, filed on Sep. 18, 2023.

(51) Int. Cl.
*A44C 7/00* (2006.01)

(52) U.S. Cl.
CPC ..... *A44C 7/003* (2013.01)

(58) Field of Classification Search
CPC ..... A44C 7/003; A44C 7/004; A44C 7/005; A44C 7/006; A44C 7/007; A44C 7/008; A44C 7/00
See application file for complete search history.

(56) References Cited

U.S. PATENT DOCUMENTS 1,361,204 A * 12/1920 Udesen ..... A44B 9/06 24/711.1
2,795,118 A * 6/1957 Shill ..... A44C 7/008 63/14.3
3,504,507 A * 4/1970 Ferro ..... A44C 7/002 63/29.1
4,468,936 A 9/1984 Kirk et al.
4,781,036 A * 11/1988 Erickson ..... A44C 7/002 63/29.1
5,020,338 A 6/1991 Payne
5,076,072 A 12/1991 Payne
5,345,927 A * 9/1994 Bonutti ..... A61B 17/0218 606/198
5,638,700 A 6/1997 Shechter
9,764,433 B2 * 9/2017 Giorlando ..... A44C 7/003
2004/0007911 A1 1/2004 Smith
2008/0161805 A1 * 7/2008 Saravia ..... A61B 17/7266 606/60
2009/0005782 A1 * 1/2009 Chirico ..... A61B 17/8811 606/300
2012/0096897 A1 4/2012 Bailey
2013/0174606 A1 * 7/2013 Jarrell ..... A44C 7/003 63/1.18
2018/0132578 A1 * 5/2018 Jarrell ..... A44C 15/0035
2022/0183728 A1 * 6/2022 Fagan ..... A61B 17/7266
(Continued)

*Primary Examiner* — Emily M Morgan
(74) *Attorney, Agent, or Firm* — Troutman Pepper Locke, LLP; Gabrielle L. Gelozin; Jeremy E. Murphy

(57) ABSTRACT

A closure for a piece of jewelry includes a first end configured to be inserted through a skin piercing the first end including a tail, a second end opposite the first end, and a center section extending along an axis between the first end and the second end. The second end includes a decorative piece. The tail is configured for rotation about the axis to move the center section between a retracted position in which the first end is able to pass through the skin piercing until the decorative piece abuts with the skin and an expanded position in which the first end is unable to pass through the skin piercing such that the skin is held between the decorative piece and the expanded center section.

11 Claims, 7 Drawing Sheets

(56) References Cited

U.S. PATENT DOCUMENTS

| | | | | |
|---|---|---|---|---|
| 2022/0287418 | A1 | 9/2022 | Cappiello | |
| 2023/0263277 | A1* | 8/2023 | Julie | A44C 15/0035 63/12 |
| 2024/0398075 | A1* | 12/2024 | Kuhn | A44C 9/0092 |

* cited by examiner

CLOSURE FOR JEWELRY

CROSS-REFERENCE TO RELATED APPLICATIONS

This application claims priority to and the benefit of U.S. Provisional Application No. 63/538,876, filed Sep. 18, 2023, the entire contents of which are herein incorporated by reference in their entirety.

FIELD

This disclosure relates to closures for jewelry pieces, and in particular closures for an earring.

BACKGROUND

Earring closures typically include a closing mechanism that is separately attached to an earring post after insertion into an ear. To insert or remove the earring, the earring backing is usually fully detached from the earring post, creating two separate pieces, the backing and the earring itself. However, these two-piece systems make it easy for the backing to come loose and fall out, and can be easily dropped and lost during the insertion or removal, resulting in losing the entire earring.

Conventional earring closures have generally been considered satisfactory for their intended purpose. However, there is still a need in the art for improvements. The present disclosure provides a solution for this need.

SUMMARY

A closure for a piece of jewelry includes a first end configured to be inserted through a skin piercing the first end including a tail, a second end opposite the first end, and a center section extending along an axis between the first end and the second end. The second end includes a decorative piece. The tail is configured for rotation about the axis to move the center section between a retracted position in which the first end is able to pass through the skin piercing until the decorative piece abuts with the skin and an expanded position in which the first end is unable to pass through the skin piercing such that the skin is held between the decorative piece and the expanded center section.

In certain embodiments, the tail can include a textured portion configured to provide a grip for a user. In certain embodiments, the closure can further include a post connecting the center section to the decorative piece. The closure can be configured such that with the center section in the expanded position, only the post is within the skin piercing. The center section can further include a plurality of expanding members configured to extend radially outward from the axis in the expanded position. The decorative piece can be operatively associated with the post.

The plurality of expanding members can fan out to form a star shape. The plurality of expanding members can include five expanding members. The plurality of expanding members can include seven, eight, or nine expanding members.

The plurality of expanding members can be operatively associated with the tail such that rotation of the tail causes the plurality of expanding members to be pushed towards the decorative piece to move from the retracted position to the expanded position. Each expanding member of the plurality of expanding members can include a first portion and a second portion operatively connected to one another via a first hinge. For each expanding member of the plurality of expanding members, the first portion can be operatively associated with the tail via a second hinge and the second portion can be operatively connected to the post via a third hinge. In certain embodiments, the closure can further include a plurality of webbing members connecting between respective expanding members of the plurality of expanding members.

In certain embodiments, the closure can further include a threaded member extending between the tail and the post. In the retracted position, the plurality of expanding members can enclose the threaded member. The post can include at least one interior thread configured to engage with the threaded member to drive the center portion between the retracted position and the expanded position.

Rotation of the tail in a first direction can be configured to cause threaded engagement between the at least one internal thread of the post with thread of the threaded member to pull the post axially along the threaded member towards the first end while the expanding members move radially outwards from the threaded member to the expanded position. In the expanded position, the skin piercing can be sandwiched between the expanding members and the decorative piece.

In certain embodiments, the closure can further include a locking mechanism having a first portion disposed on the tail and a second portion disposed on the post. In in the expanded position, the first portion of the locking mechanism can mate with and lock onto the second portion of the locking mechanism to hold the closure in the expanded position.

Rotation of the tail in a second direction, opposite the first direction, can be configured to cause threaded engagement between the at least one internal thread of the post with thread of the threaded member to push the post axially along the threaded member towards the second end while the expanding members move radially inwards towards the threaded member to the retracted position. The first portion of the locking mechanism can include one or more female features and the second portion of the locking mechanism can include one or more male features configured to mate with one or more female features of the first portion of the locking mechanism.

An earring includes a jewelry portion having a decorative face, a non-decorative face, and a post extending outwardly from the non-decorative face along an axis. The earring also includes a closure operatively connected to the post. The closure is configured for rotation about the axis to move the closure between a first position in which the post is able to pass through a skin piercing until the non-decorative face abuts with the skin and a second position in which the skin of the skin piercing is held between the decorative piece and the closure.

A method of closing the earring can include twisting the closure in a first direction to move the closure to the first position in which the earring is secured to an ear of a wearer and twisting the closure in the second direction to move the closure from the first position to the second position in which the earring is able to be removed from the ear of the wearer.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
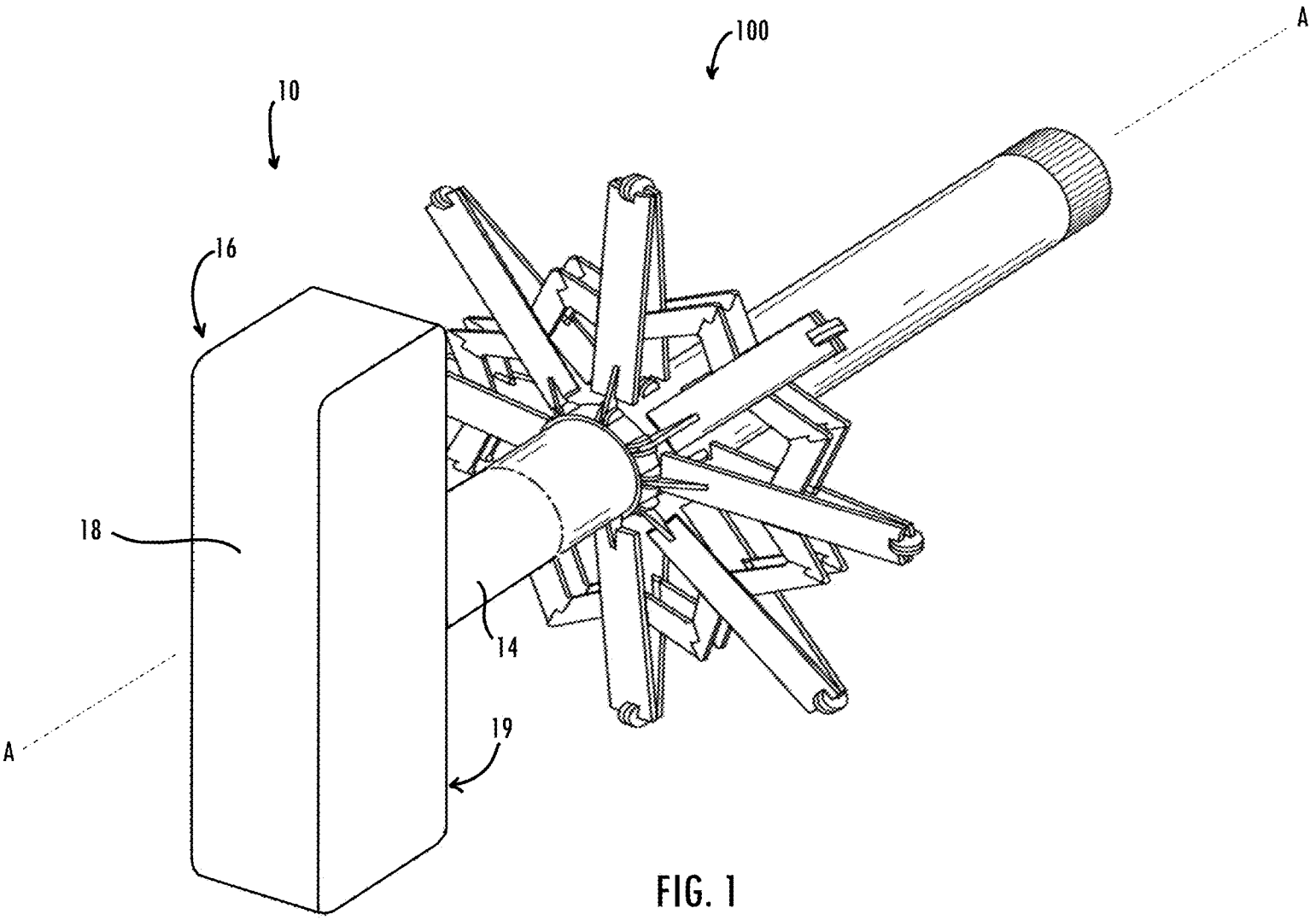
FIG. 1 is a front perspective view of a piece of jewelry in accordance with this disclosure showing an embodiment of a closure.

Reference will now be made to the drawings wherein like reference numerals identify similar structural features or aspects of the subject disclosure. For purposes of explanation and illustration, and not limitation, an illustrative view of an embodiment of a piece of jewelry in accordance with the disclosure is shown in FIG. 1 and is designated generally by reference character 10. Other embodiments and/or aspects of this disclosure are shown in FIGS. 2-7.

Figure 2:
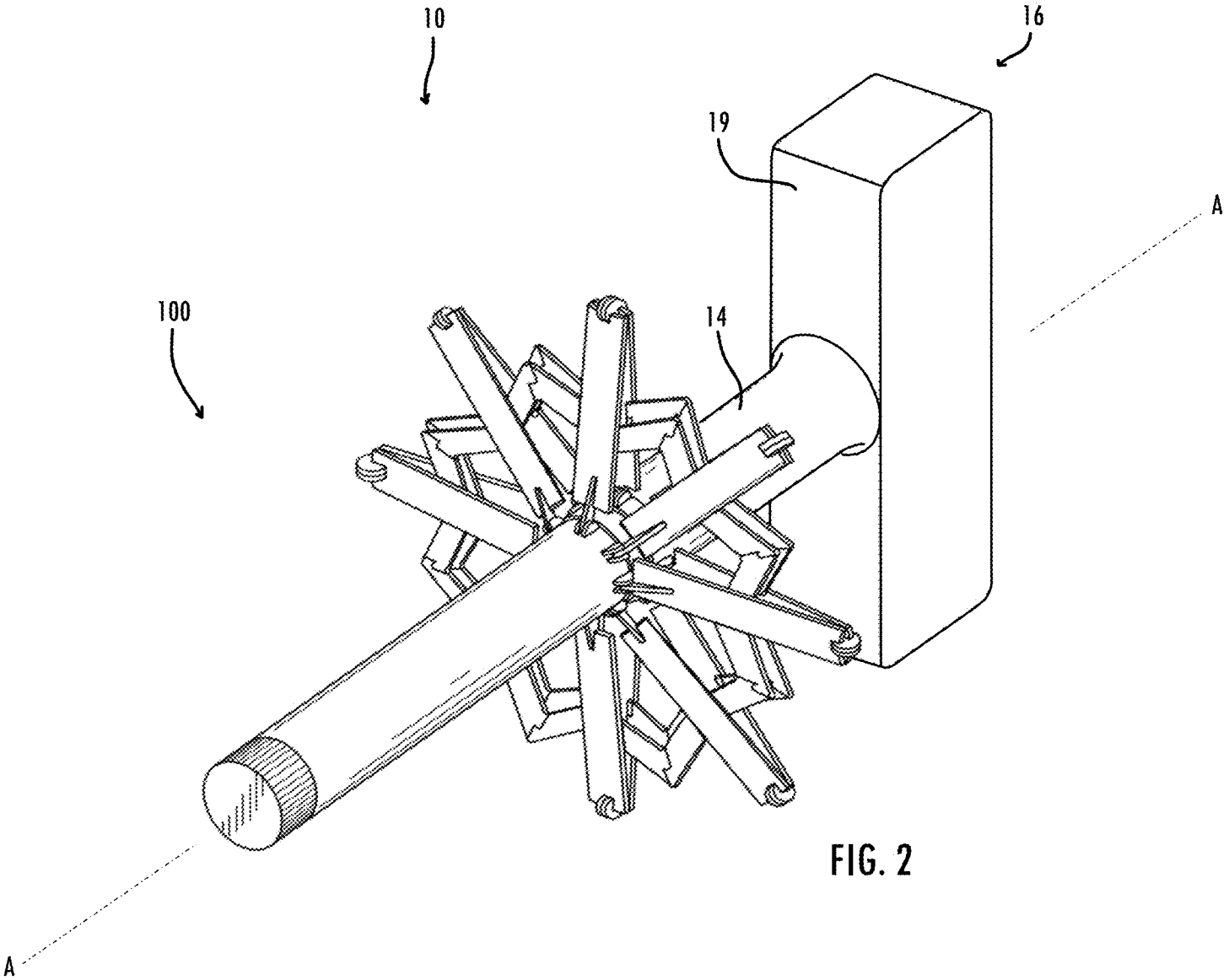
FIG. 2 is a rear perspective view of the piece of jewelry.
Figure 3:
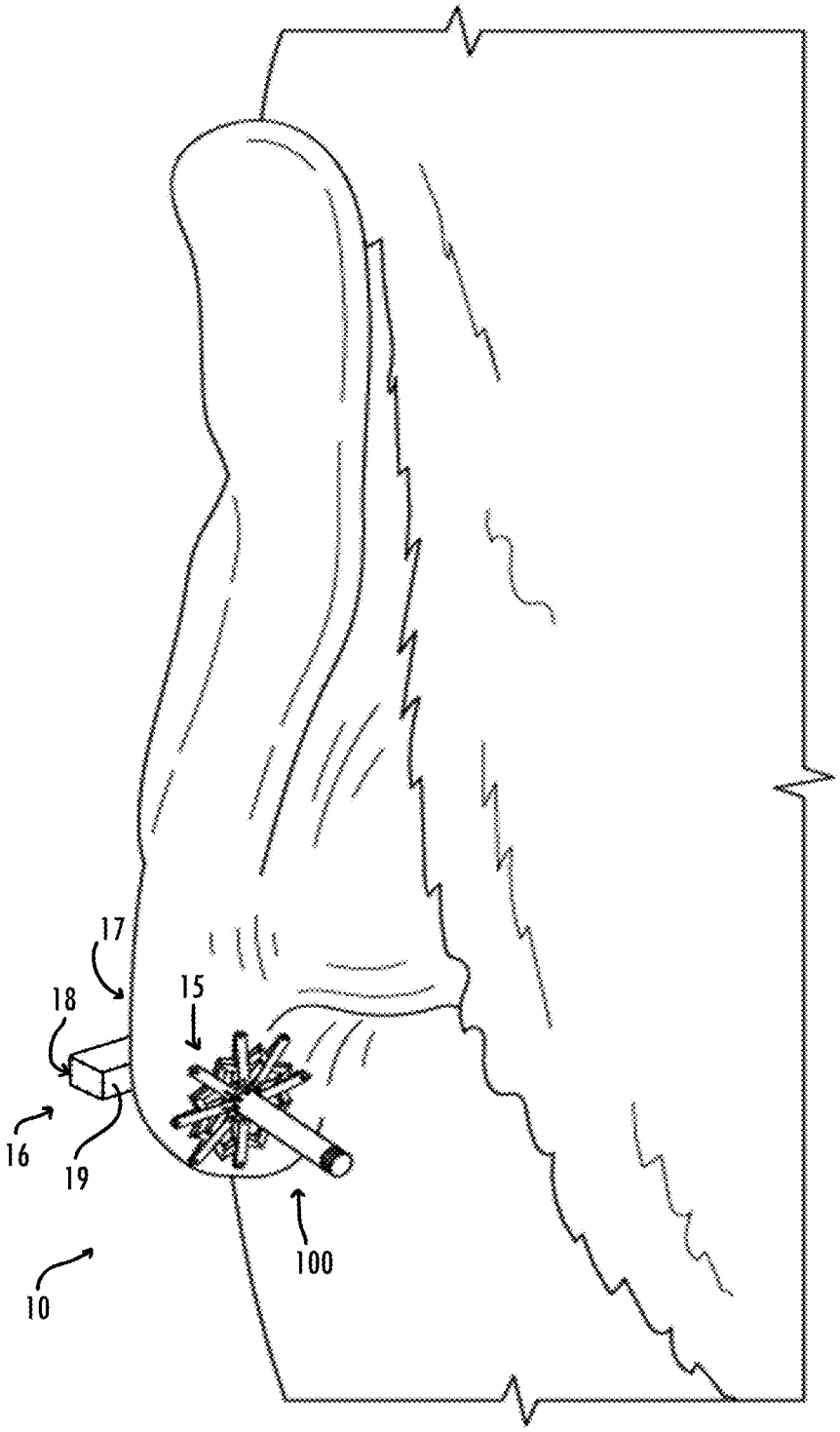
FIG. 3 is a rear perspective view of the piece of jewelry shown held in a skin piercing.

In accordance with at least one aspect of this disclosure, as shown in FIGS. 1-3, a piece of jewelry is shown. In certain embodiments, as described herein, the piece of jewelry is an earring 10 and includes a decorative portion 16 having a decorative face 18, a non-decorative face 19, and a post 14 extending outwardly from the non-decorative face 19 along an axis A. The earring 10 also includes a closure 100 operatively connected to the post 14. The closure 100 is configured for rotation about the axis A to move the closure 100 between a first position (a retracted position) and a second position (an expanded position), where the closure is shown in the expanded position FIGS. 1-3 and 6.

In the first position, as shown in FIG. 3, the post 14 (which is obstructed by the ear lobe in FIG. 3) is able to pass through a skin piercing 15 until the non-decorative face 19 abuts with the skin (e.g., a forward face of an ear lobe 17). In the expanded position, e.g., such as shown in FIGS. 1-3 and 6, the skin of the skin piercing (e.g., the ear lobe) is held between the decorative piece 16 and the closure 100. FIG. 3 shows the earring 10 inserted into skin piercing in an ear lobe, where the closure 100 is in the second position to retain the earring within the ear.

Figure 4:
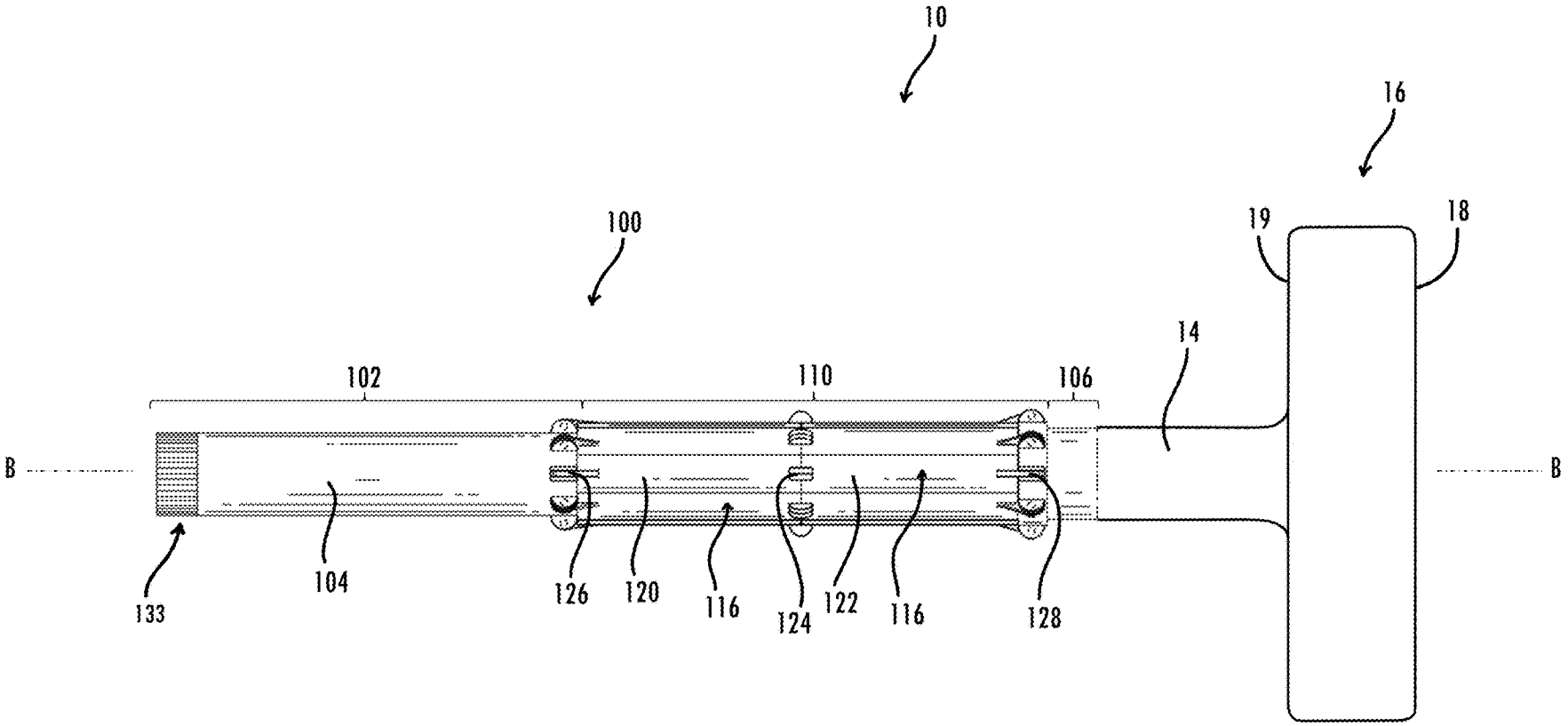
FIG. 4 is a side elevational view of the piece of jewelry, showing the closure in a retracted position.
Figure 5:
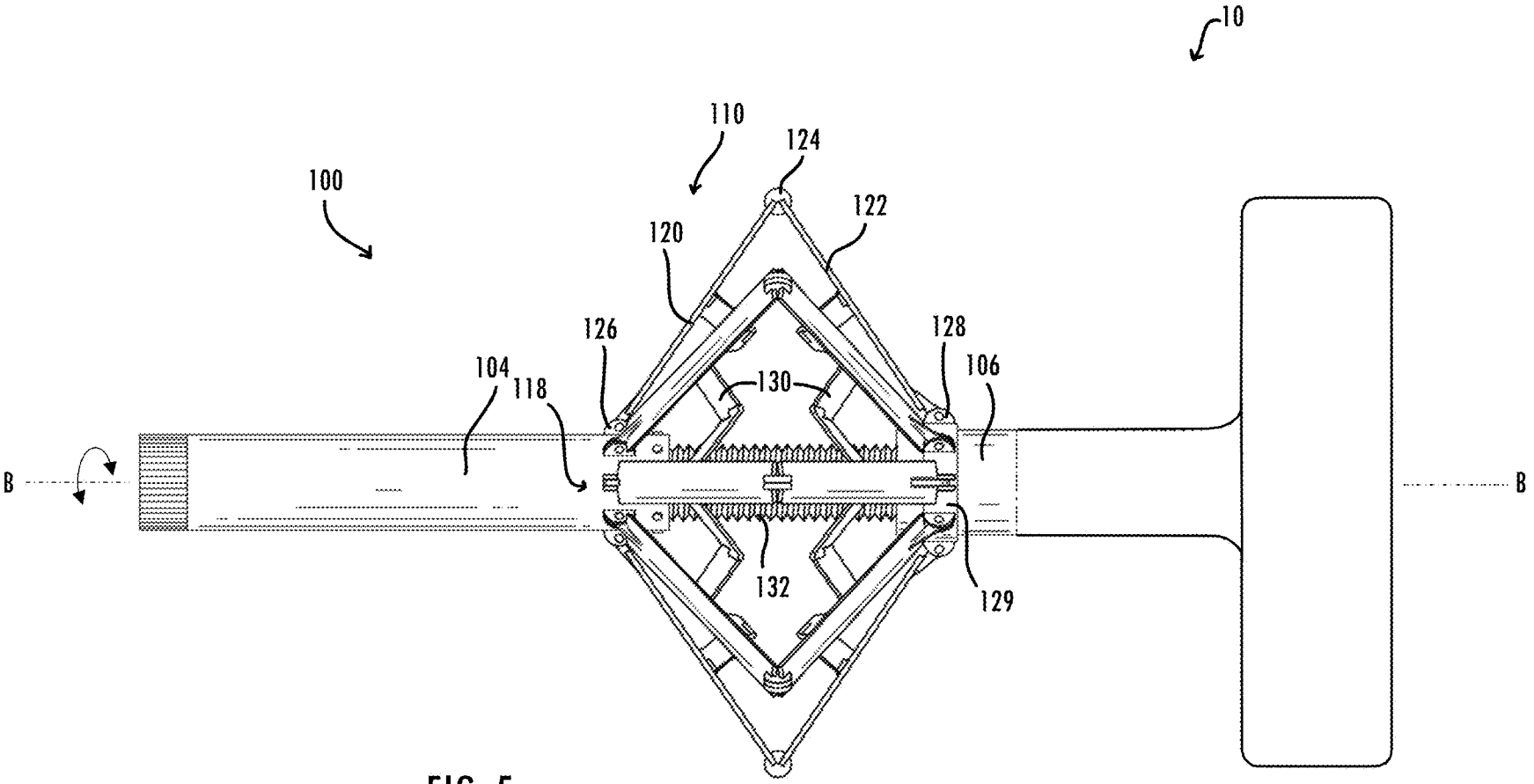
FIG. 5 is a side elevational view of the piece of jewelry, showing the closure moving from the retracted position to an expanded position.
Figure 6:
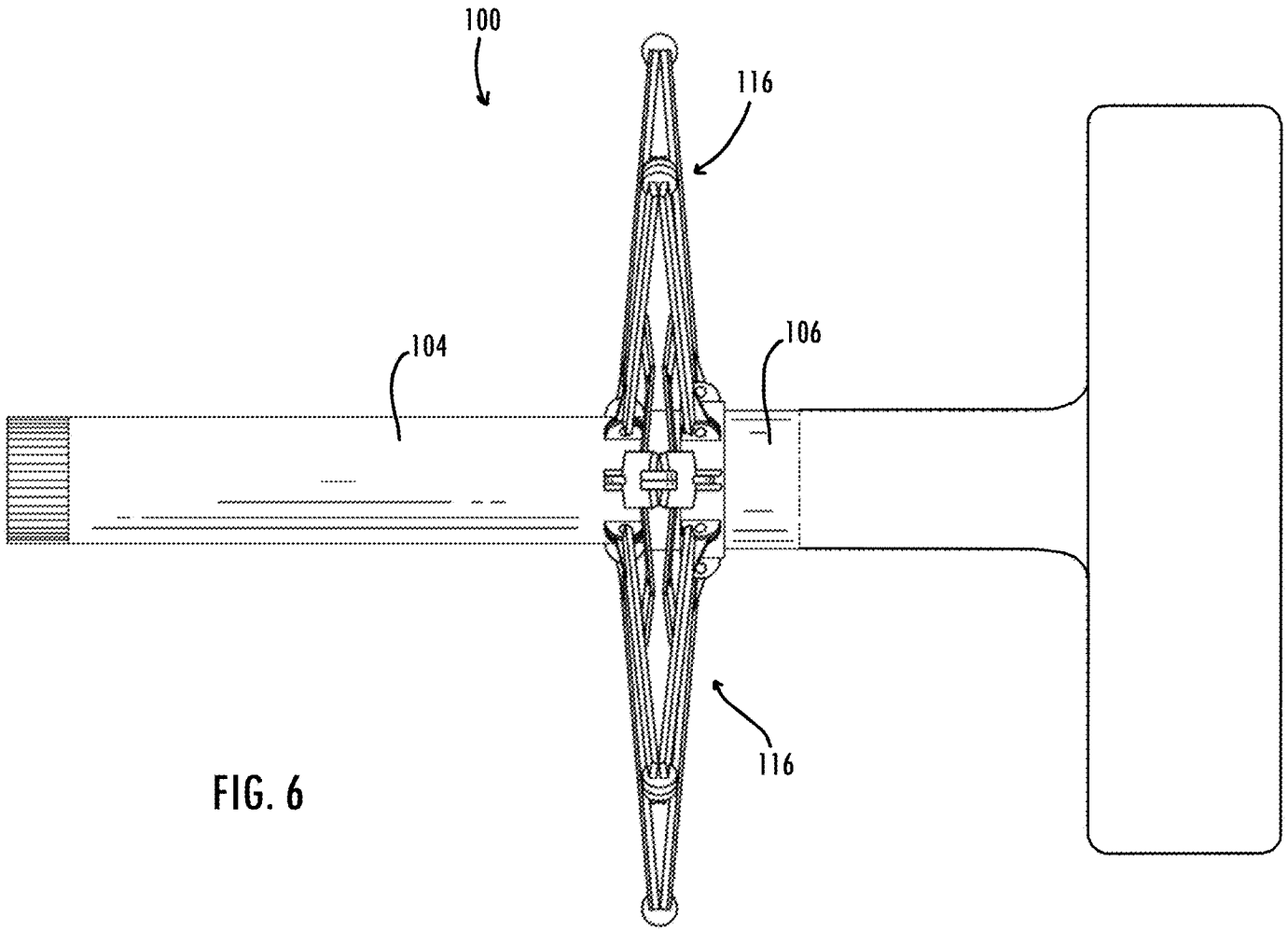
FIG. 6 is a side elevational view of the piece of jewelry, showing the closure in the expanded position.

Referring now to FIGS. 4-6, the closure 100 will be described more in depth. The closure 100 includes a first end 102 configured to be inserted through the skin piercing, where the first end 102 includes a tail 104, and a second end 106 is opposite the first end 102. A center section 110 extends along an axis B, which can be coaxial with axis A, between the first end 102 and the second end 106. The second end 106 is operatively (e.g., rotatably) connected to the post 14, which holds the decorative piece 16. The tail 104 is configured for rotation about the axis B to move the center section 110 between the first position and the second position. The post 14 connects the second end 106 of the closure 100 to the decorative piece 16 at the non-decorative face 19. The closure 100 can be configured such that with the center section 110 in the expanded position, only the post 14 is within the skin piercing.

Still with reference to FIGS. 4-6, the center section 110 can further include a plurality of expanding members 116 configured to extend radially outward from the axis B in the expanded position with rotation of the tail 104. The plurality of expanding members 116 can fan out to form a star shape, e.g., as best seen in FIGS. 1-3. The plurality of expanding members 116 can include five expanding members, or in certain embodiments can include seven expanding members, eight expanding members, or up to nine expanding members.

The plurality of expanding members 116 are operatively associated with the tail 104 on an outer surface 118 of the tail 104. The expanding members 116 can be connected to the tail in a manner such that rotation of the tail 104 causes the plurality of expanding members 116 to be pushed towards the decorative piece 16 to move the closure 100 from the retracted position to the expanded position. For example, as shown, each expanding member 116 can include a first portion 120 and a second portion 122 operatively connected to one another via a first hinge 124. For each expanding member 116 of the plurality of expanding members 116, the first portion 120 can be operatively associated with the tail 104 via a second hinge 126 and associated with the second portion 106 via a third hinge 128 disposed on a collar 129. In certain embodiments, the closure 100 can further include a plurality of webbing members 130 connecting between respective expanding members 116 of the plurality of expanding members 116.

With reference to FIG. 5, the closure 100 further includes a threaded member 132 (e.g., screw or bolt) extending between the tail 104 and the second end 106. In the retracted position (shown in FIG. 4), the plurality of expanding members 116 fully enclose the threaded member 132. The tail 104 includes at least one interior thread configured to engage with the threaded member 132 to move the expanding members 116 between the retracted position and the expanded position.

Rotation of the tail 104 in a first direction (e.g., clockwise) causes threaded engagement between the at least one internal thread of the tail 104 and the threaded member 132 to push the tail 104 axially along the threaded member 132 towards the second end 106. In doing so, the expanding members 116 move radially outwards from the threaded member 132 to the expanded position. This is shown in the progression from FIG. 4 to FIG. 5 to FIG. 6. Said differently, rotation of the tail 104 in the first direction, e.g., a clockwise direction, screws the tail 104 forward (e.g., to the right as shown in the FIGS.) in the direction of the decorative piece 16 to push the expanding members 116 outward into the expanded position. When wearing the earring and securing the earring 10 in the ear, rotation of the tail in the first direction occurs after the tail is inserted through the skin piercing. In the expanded position, the skin piercing (e.g., the ear lobe in this example) is sandwiched between the expanding members 116 and the decorative piece 16, as shown and described with respect to FIG. 3. In certain embodiments, the tail 104 can include a textured portion 133 configured to provide the user with a better grip while turning the tail.

Figure 7:
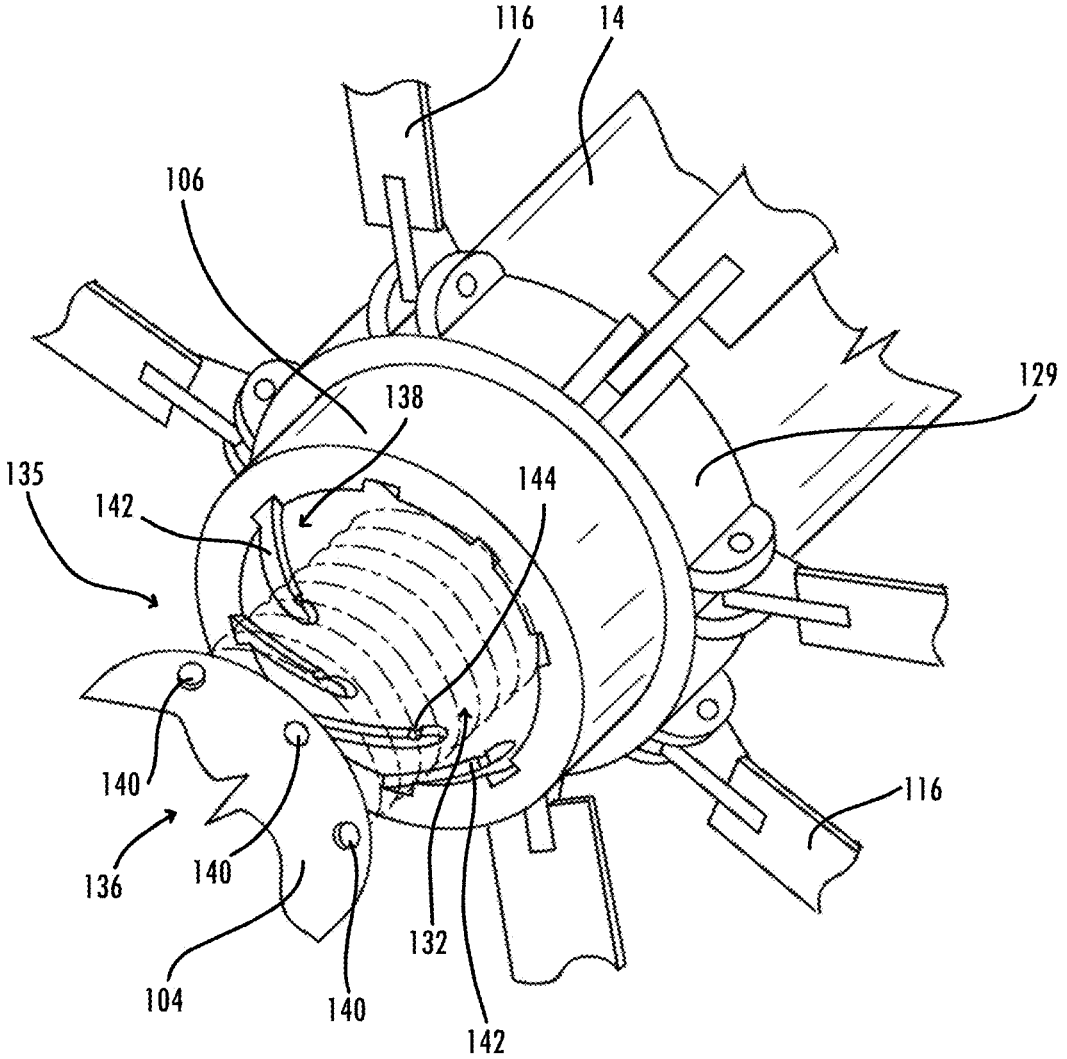
FIG. 7 is an enlarged partial view of a locking mechanism of the closure in accordance with this disclosure.

With reference now to FIG. 7, in certain embodiments, the closure 100 can further include a locking mechanism 135 having a first portion 136 disposed on the tail 104 and a second portion 138 defined in the second end 106. To lock the closure 100 in the expanded position, the first portion 136 of the locking mechanism mates with and locks into the second portion 138 of the locking mechanism to hold the closure 100 in the expanded position. The first portion 136 of the locking mechanism can include one or more male features 140 and the second portion 138 of the locking mechanism 135 can include one or more female features 142. When the tail is turned into tine locking mechanism, the male features 140 mate with the female features 142 to lock the tail in a final axial position. In embodiments, a number of male features 140 is equal to a number of female features 142.

As shown, the male features 140 can be protrusions extending radially outward from the tail, and the female features 142 can be slots defined in an inner surface of the second end 106. A ridge 144 can be defined in the slots 142 to require greater force to be used to turn the tail 104 past the ridge 144, than a force used to turn the tail 104 when moving the tail 104 from the retracted position to the expanded position. Thus, when locked, the tail is not able to be easily moved out of the expanded position, such as by small movements like daily walking or exercise by the wearer. Additionally, moving the male features past the ridge can result in an audible and/or tactile "click" indicating to the wearer that the closure 100 is now locked in the expended position. When the closure 100 is in the expanded position and locked in place, the tail 104 fully encases the threaded member 132, such as shown in FIG. 6.

To return the closure 100 to the retracted position, the tail 104 is rotated in the second direction (e.g. counterclockwise). Rotation of the tail 104 in a second direction causes threaded engagement between the at least one internal thread of the tail 104 with thread of the threaded member 132 to pull the tail 104 axially along the threaded member 132 towards first end 102 (e.g., to the left looking at the FIGS.) while the expanding members 116 move radially inwards towards the threaded member 132 to the retracted position. Now back in the retracted position, the earring 10 would be able to be removed from the skin piercing.

An explanation of how the piece of jewelry 10 is operated and used in an ear piercing is described next. First, the closure 100 in the retracted position is placed into the pierced lobule of the ear. At this step, the closure 100 will pass completely through the piercing so that the post 14 is the only portion of the piece of jewelry 10 that is within the earlobe. Next, the tail end 104 of the closure 100 is turned to the right. As the end is turned to the right, the middle of the closure (e.g., the expanding members 116) will begin to open from the middle in a star-shaped manner. As the center section of the closure 100 opens, the tail end 104 moves forward, towards the ear lobe, encapsulating an inner threaded member 132 within the tail. After a number of complete turns, for example three complete turns, the tail end will be adjacent a forward end 106 of the closure. A partial turn to the right will allow case a locking mechanism 135 to lock the tail portion 104 into the forward portion 106, securing itself into a backing. The manner in which the expanding members 116 open is similar to that of an umbrella, where in the completely expanded position, the expanding members 116 form a star shape (e.g., as shown). In this fully expanded position, after the closure 100 is fully formed into a secure star, the stud earring is held in place by sandwiching the ear lobe between the expanded star shaped backing (closure 100) and the actual decorative stud portion of the earring.

To remove the stud earring 10, the tail end 104 of the stud 10 is turned to the left to unlock, a reverse of how the closure is closed. As the tail 104 is turned to the left, the expanding members 116 pull back (away from the decorative end) and return to a flat position, extending along the stud axis A. Once in this position, the user can then remove the stud from the earlobe.

Certain embodiments of jewelry 10 and closure 100 described herein offer a functional alternative to traditional stud earrings that require separate jewelry pieces to keep them secure. The "backless" single piece stud earring includes a closure that configured and adapted to be comfortable, secure, versatile, and suitable for all individuals with pierced ears or other certain suitable facial or body piercings.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A closure for a piece of jewelry, comprising:

a first end configured to be inserted through a skin piercing, the first end including a tail;

a second end opposite the first end;

a decorative piece;

a center section extending along an axis between the first end and the second end, wherein the tail is configured for rotation about the axis to move the center section between: a retracted position in which the first end is able to pass through the skin piercing until the decorative piece abuts with skin surrounding the skin piercing; and an expanded position in which the first end is unable to pass through the skin piercing such that the skin surrounding the skin piercing is held between the decorative piece and the expanded center section a post extending from the decorative piece along the axis connecting the second end to the decorative piece, wherein the closure is configured such that with the center section in the expanded position, only the post is within the skin piercing, wherein the center section further includes a plurality of expanding members configured to extend radially outward from the axis in the expanded position, wherein the plurality of expanding members are operatively associated with the tail such that rotation of the tail causes the plurality of expanding members to be pushed towards the decorative piece to move from the retracted position to the expanded position, wherein each expanding member of the plurality of expanding members includes a first portion and a second portion operatively connected to one another via a first hinge, wherein for each expanding member of the plurality of expanding members, the first portion is operatively associated with the tail via a second hinge and the second portion is operatively connected to the post via a third hinge; and a plurality of webbing members connecting between respective expanding members of the plurality of expanding members.

2. The closure of claim 1, further comprising a threaded member extending between the tail and the post, wherein in the retracted position, the plurality of expanding members enclose the threaded member.

3. The closure of claim 2, wherein the tail includes at least one interior thread configured to engage with the threaded member to drive the center portion between the retracted position and the expanded position.

4. The closure of claim 3, wherein rotation of the tail in a first direction is configured push the tail axially along the threaded member towards the second end while the expanding members move radially outwards from the threaded member to the expanded position, wherein in the expanded position, skin surrounding the skin piercing is sandwiched between the expanding members and the decorative piece.

5. The closure of claim 4, further comprising a locking mechanism having a first portion disposed on the tail and a second portion disposed on the second end, wherein in the expanded position, the first portion of the locking mechanism mates with and locks into the second portion of the locking mechanism to hold the closure in the expanded position.

6. The closure of claim 5, wherein rotation of the tail in a second direction, opposite the first direction, is configured to pull the tail axially along the threaded member towards the first end and away from the decorative piece while the expanding members move radially inwards towards the threaded member to the retracted position.

7. The closure of claim 6, wherein the first portion of the locking mechanism includes a one or more male features, and the second portion of the locking mechanism includes one or more female features configured to mate with one or more male features of the first portion of the locking mechanism.

8. The closure of claim 1, wherein the tail includes a textured portion configured to provide a grip for a user.

9. A closure for a piece of jewelry, comprising:

a first end configured to be inserted through a skin piercing, the first end including a tail;

a second end opposite the first end;

a decorative piece;

a center section extending along an axis between the first end and the second end, wherein the tail is configured for rotation about the axis to move the center section between: a retracted position in which the first end is able to pass through the skin piercing until the decorative piece abuts with skin surrounding the skin piercing; and an expanded position in which the first end is unable to pass through the skin piercing such that the skin surrounding the skin piercing is held between the decorative piece and the expanded center section, a post extending from the decorative piece along the axis connecting the second end to the decorative piece, wherein the closure is configured such that with the center section in the expanded position, only the post is within the skin piercing, wherein the center section further includes a plurality of expanding members configured to extend radially outward from the axis in the expanded position, wherein the plurality of expanding members are operatively associated with the tail such that rotation of the tail causes the plurality of expanding members to be pushed towards the decorative piece to move from the retracted position to the expanded position, wherein each expanding member of the plurality of expanding members includes a first portion and a second portion operatively connected to one another via a first hinge, wherein for each expanding member of the plurality of expanding members, the first portion is operatively associated with the tail via a second hinge and the second portion is operatively connected to the post via a third hinge;

a threaded member extending between the tail and the post, wherein in the retracted position, the plurality of expanding members enclose the threaded member, wherein the tail includes at least one interior thread configured to engage with the threaded member to drive the center portion between the retracted position and the expanded position, wherein rotation of the tail in a first direction is configured push the tail axially along the threaded member towards the second end while the expanding members move radially outwards from the threaded member to the expanded position, wherein in the expanded position, skin surrounding the skin piercing is sandwiched between the expanding members and the decorative piece; and a locking mechanism having a first portion disposed on the tail and a second portion disposed on the second end, wherein in the expanded position, the first portion of the locking mechanism mates with and locks into the second portion of the locking mechanism to hold the closure in the expanded position.

10. The closure of claim 9, wherein rotation of the tail in a second direction, opposite the first direction, is configured to pull the tail axially along the threaded member towards the first end and away from the decorative piece while the expanding members move radially inwards towards the threaded member to the retracted position.

11. The closure of claim 10, wherein the first portion of the locking mechanism includes a one or more male features, and the second portion of the locking mechanism includes one or more female features configured to mate with one or more male features of the first portion of the locking mechanism.

* * * * *